US006966136B2

(12) United States Patent
Connors

(10) Patent No.: US 6,966,136 B2
(45) Date of Patent: Nov. 22, 2005

(54) SIGN SYSTEM WITH INTERCHANGEABLE LENSES

(76) Inventor: Peter J. Connors, 190 Ridgewood Rd., Radnor, PA (US) 19087

( * ) Notice: Subject to any disclaimer, the term of this patent is extended or adjusted under 35 U.S.C. 154(b) by 0 days.

(21) Appl. No.: 10/981,317

(22) Filed: Nov. 4, 2004

(65) Prior Publication Data

US 2005/0063778 A1 Mar. 24, 2005

Related U.S. Application Data

(62) Division of application No. 10/663,134, filed on Sep. 16, 2003.

(60) Provisional application No. 60/463,607, filed on Apr. 18, 2003.

(51) Int. Cl.[7] ..... G09F 7/00

(52) U.S. Cl. ..... 40/605; 40/606.14; 40/611.01; 40/611.06; 40/611.13; 40/612; 404/6; 116/63 P

(58) Field of Search ..... 40/584, 605, 612, 40/606.01, 606.14, 611.01, 611.06, 611.07, 40/611.13; 404/6; 116/63 R, 63 P

(56) References Cited

U.S. PATENT DOCUMENTS

| | | | | |
|---|---|---|---|---|
| 1,724,647 | A * | 8/1929 | Eberspacher | 40/612 |
| 4,183,695 | A | 1/1980 | Wilcox | |
| 4,312,600 | A | 1/1982 | Schaaf et al. | |
| 4,318,238 | A | 3/1982 | Macarle | |
| 5,339,765 | A | 8/1994 | Ward | |
| 5,860,237 | A | 1/1999 | Johnson | |
| 2003/0101628 | A1 | 6/2003 | Gort | |

OTHER PUBLICATIONS

Manual on Uniform Traffic Control, Federal Highway Administration, Section 6F.60 Type I, II, and III Barricades.

* cited by examiner

*Primary Examiner*—Gary C. Hoge
(74) *Attorney, Agent, or Firm*—Caesar, Rivise, Bernstein, Cohen & Pokotilow, Ltd.

(57) ABSTRACT

A transparent, reversible sign for use in traffic barricades.

7 Claims, 7 Drawing Sheets

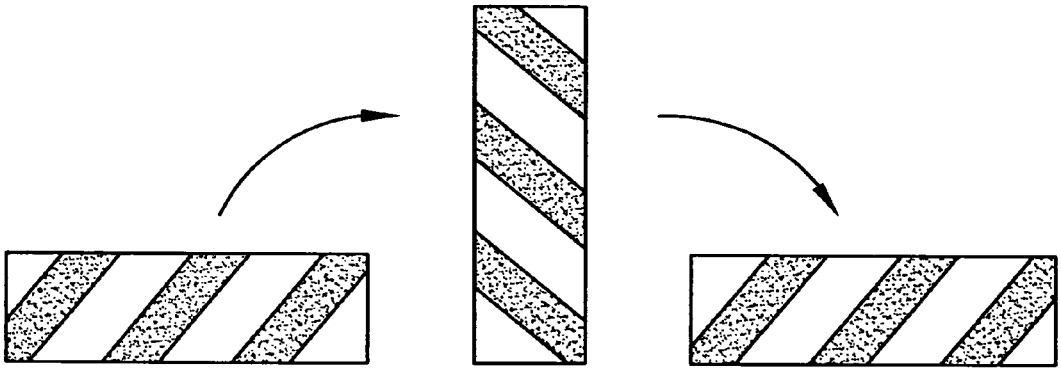
FIG. 3A (Prior Art) FIG. 3B (Prior Art) FIG. 3C (Prior Art)
FIG. 4A
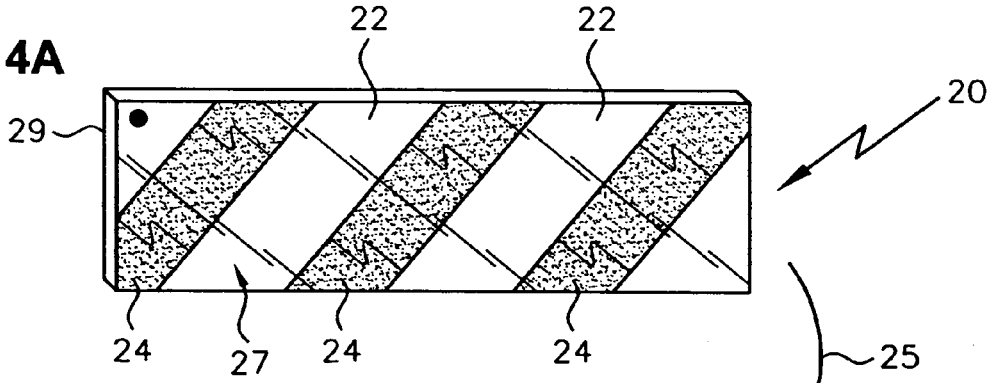
FIG. 4B
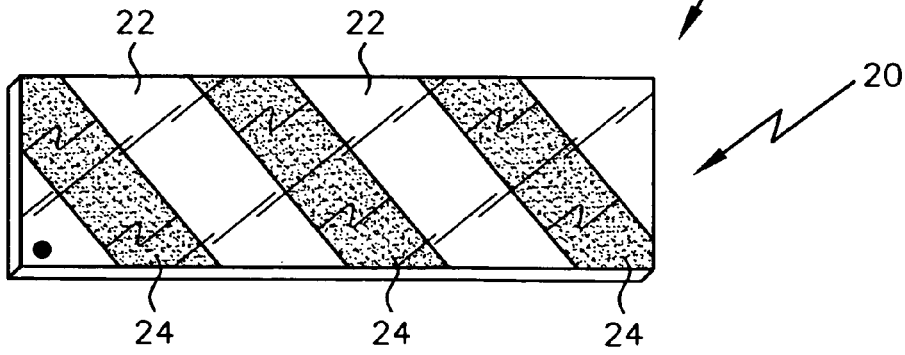

SIGN SYSTEM WITH INTERCHANGEABLE LENSES

CROSS-REFERENCE TO RELATED APPLICATIONS

This application is a divisional application of, and claims the benefit under 35 U.S.C. §121 of, application Ser. No. 10/663,134 filed on Sep. 16, 2003 entitled SIGN SYSTEM WITH INTERCHANGEABLE LENSES, which in turn, is a utility application of, and claims the benefit under 35 U.S.C. §119(e) of U.S. Provisional application Ser. No. 60/463,607 filed on Apr. 18, 2003 entitled REVERSIBLE SAFETY STRIPE SYSTEM and all of whose entire disclosures are incorporated by reference herein.

BACKGROUND OF THE INVENTION

1. Field of Invention

This invention relates to traffic barricades, and more particularly, to an interchangeable traffic barricade.

2. Description of Related Art

In accordance with the Federal Highway Administration (FHA) Manual on Uniform Traffic Control (MUTCD), as well as the proposed FHA "Millenium Standard," traffic barricades used by contractors at road construction sites must properly instruct drivers in which direction to veer to avoid traffic obstructions by applying reflective sheeting which displays diagonal white and orange stripes. The well-known barricade indicia shown in FIGS. 1A and 1B instruct drivers to veer to the left, or veer to the right, respectively. Typically, this "slanted bar" (an orange band) traffic flow instruction indicia is located on a stand, (e.g., sawhorse style) and is referred to as a "Type I" sign. Moreover, a pair of these "slanted bar" traffic flow instruction indicia can be vertically-aligned on a stand to form a "Type II" sign (see FIG. 2A); where one of these "slanted bar" traffic flow instruction indicia is replaced with an "arrow", that is known as a "Directional Type II" sign (see FIG. 2B).

However, currently, manufacturers, such as 3M®, provide barricade rental companies with large rolls of the slanted bar traffic flow instruction on a tape that is reflective. The rental company then cuts the tape according to FHA standards and applies (e.g., using an adhesive on the back of the tape) it to a plurality of barricades to form a plurality of dedicated (e.g., "veer to the left" instruction) Type I and Type II (including Directional Type II) and Type III barricades (see MUTCD, Section 6F.60 Type I, II, III Barricades). Another roll of tape, but with the slanted bar traffic flow instruction in the opposite direction, must be purchased by the rental company, cut appropriately, and then applied to another plurality of barricades to form another plurality of dedicated (e.g., "veer to the right" instruction) Type I and Type II (including Directional Type II) barricades. Not only is the tape expensive but having to make dedicated barriers is inefficient. The reason for requiring different rolls of tape for different veering instructions is best shown in FIGS. 3A–3C: if one "flips" the slanted bar design 180°, the result is the slanted bar is still in the same direction.

Thus, there remains a need for an interchangeable barricade sign that eliminates the need to require dedicated barriers which are compliant with FHA MUTCD, as well as the proposed "Millenium Standard."

BRIEF SUMMARY OF THE INVENTION

A sign for use in traffic barricades wherein the sign comprises a transparent material (e.g., clear polycarbonate, such as GE Lexan®, or acrylic or glass) having traffic flow indicia (e.g., slanted bars, arrow, etc.) thereon and wherein the sign is received in or on a traffic barricade (e.g., a Type I, Type II or Type III barricade).

A traffic barricade (e.g., a Type I, Type II or Type III barricade) comprising at least one reversible sign; and a barricade stand having a means for receiving the at least one reversible sign.

A method for providing a reversible traffic barricade wherein the method comprises the steps of: preparing at least one transparent material (e.g., clear polycarbonate, such as GE Lexan®, or acrylic or glass) having traffic flow indicia appearing thereon using translucent ink on a first side of the material; configuring a barricade stand to receive the at least one transparent material; applying a reflective coating to that portion of the barricade that receives the at least one transparent material; and releasably coupling the at least one transparent material to the barricade to form a barricade that provides traffic flow instruction in a first direction.

A traffic barricade comprising a portion for providing alternating slanted bar traffic flow indicia; a stand for supporting the portion; and wherein the alternating slanted bar traffic flow indicia comprise a plurality of slanted bar lenses, and wherein each one of the slanted bar lenses comprises a translucent material (e.g., clear polycarbonate, such as GE Lexan®, or acrylic or glass having an orange translucent ink applied thereto, or a translucent orange substrate or material) that can be positioned in a first veer direction or in a second veer direction, opposite to the first veer direction.

A method for providing a reversible traffic barricade wherein the method comprises the steps of: preparing a plurality of translucent slanted bar lenses (e.g., clear polycarbonate, such as GE Lexan®, or acrylic or glass having an orange translucent ink applied thereto, or a translucent orange substrate or material); configuring a barricade stand to receive the plurality of translucent slanted bar lenses; applying a reflective coating to that portion of the barricade that receives the plurality of slanted bar lenses; and releasably coupling the plurality of slanted bar lenses to the barricade to form a barricade that provides traffic flow instruction in a first direction.

BRIEF DESCRIPTION OF SEVERAL VIEWS OF THE DRAWINGS

The invention will be described in conjunction with the following drawings in which like reference numerals designate like elements and wherein:

FIGS. 3A–3C depict the unidirectional nature of the conventional tape used for the slanted bar traffic flow instruction indicia;

FIG. 4A shows the lens of the present invention indicating the "veer left" slanted bar traffic flow instruction;

FIG. 4B shows the lens of the present invention of FIG. 4A flipped over to provide a "veer right" slanted bar traffic flow instruction;

DETAILED DESCRIPTION OF THE INVENTION

Figure 1A:
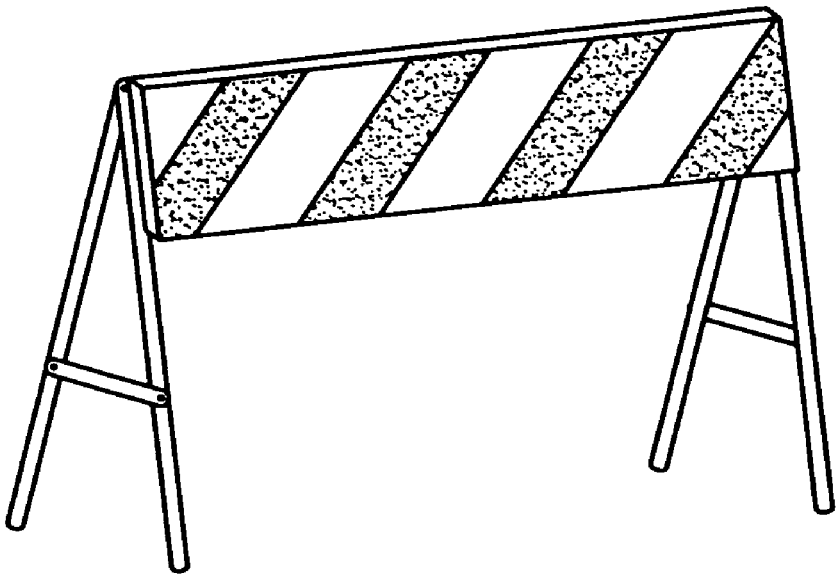
FIG. 1A (Prior Art)
FIG. 1A depicts a Type I barricade including "veer left" slanted bar traffic flow instruction indicia.
Figure 1B:
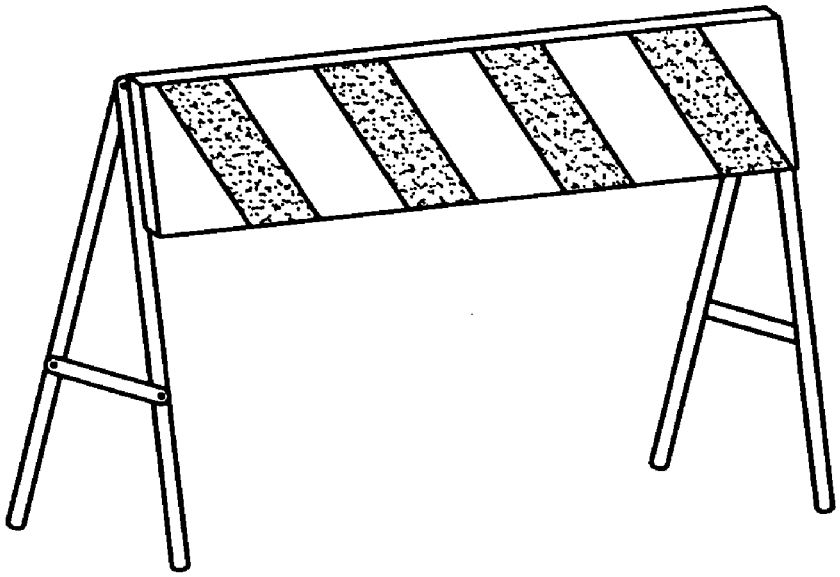
FIG. 1B (Prior Art)
FIG. 1B depicts a Type I barricade including "veer right" slanted bar traffic flow instruction indicia.

The invention 20 of the present application is shown in FIG. 4A. In particular, the invention 20 comprises a transparent material or substrate 22 (e.g., clear polycarbonate, such as GE Lexan®, or acrylic or glass) on which a translucent element (e.g., a translucent ink applied to the material or substrate 22) appears to form the traffic flow indicia. Thus, the invention 20, also referred to as a "sign" or "lens" 20, comprises alternating sections of the transparent material 22 and the translucent element 24. Moreover, because of the transparent nature of the lens 20, it can be flipped over (see arrow 25), as shown in FIGS. 4A-4B to provide either the "veer left" or the "veer right" traffic flow instruction.

Figure 5A:
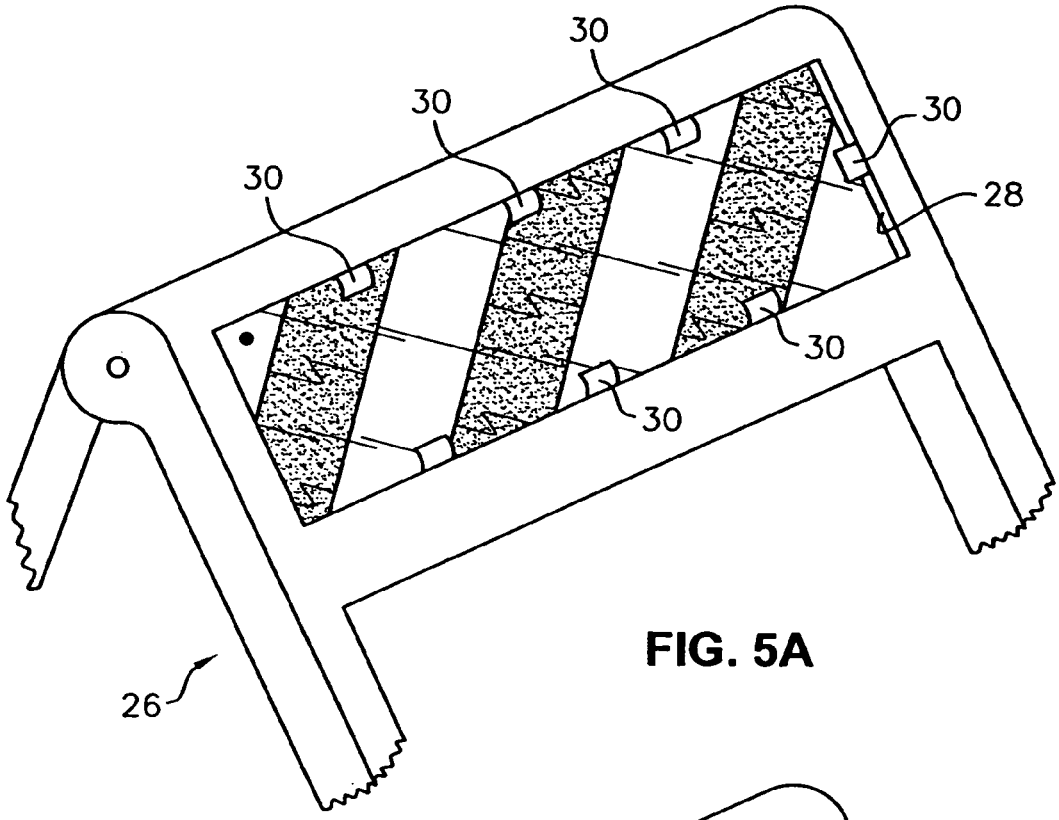
FIG. 5A shows the present invention inserted into a barricade to form a Type I "veer left" slanted bar traffic flow barricade shown partially.
Figure 5B:
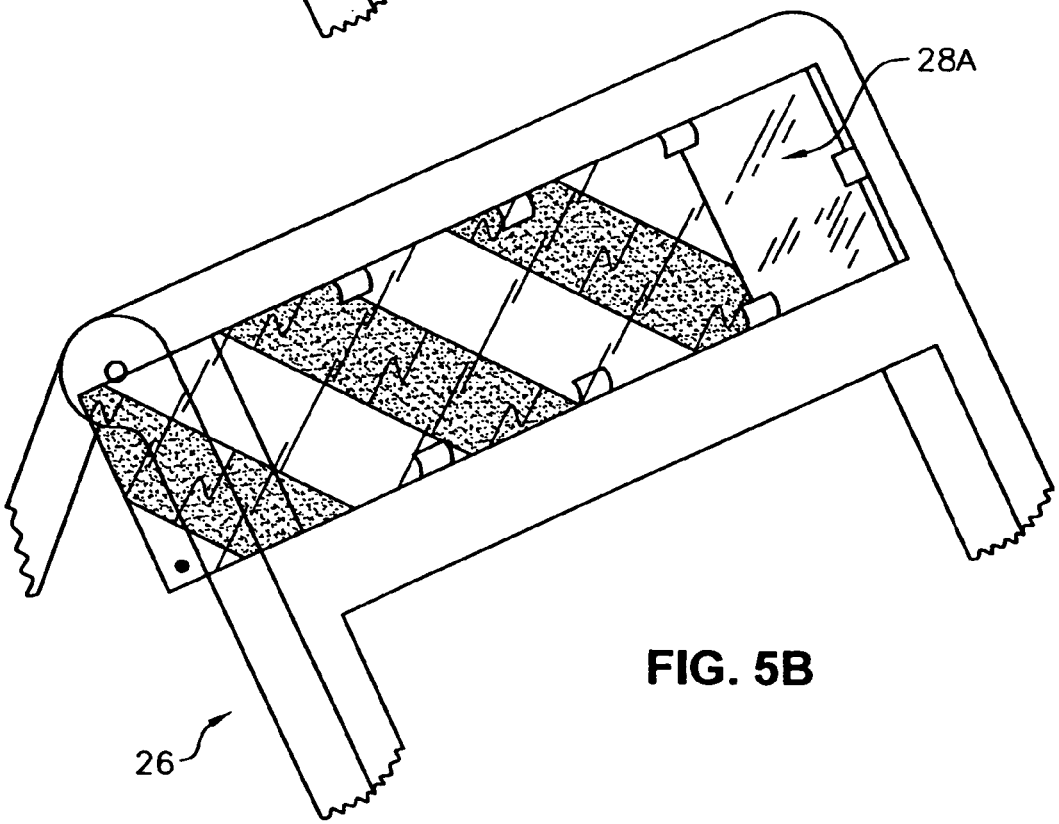
FIG. 5B shows how the present invention of FIG. 5A can be removed and reversed to form a Type I "veer right" slanted bar traffic flow barricade shown partially.

The barricade itself, 26, is configured to receive the lens 20, as shown in FIG. 5. In particular, the barricade 26 comprises a cutout, relief, or cavity or sleeve 28 in which the lens 20 can be received. A plurality of clamps, stops, etc. 30 are provided on the barricade to prevent the lens 20 from falling off the barricade 26 where a cutout, relief or cavity is used; where a sleeve is used, the clamps, stops, etc. 30 would not be required. As can be seen more clearly in FIG. 5B, the portion 28A of the cutout, relief, cavity or sleeve that forms the "background" for the lens 20 when it is inserted therein, is covered or coated with a reflective material (e.g., using a white reflective tape, such as that supplied by 3M®). Other than that, the remaining portion of the barricade 26 itself may comprise the conventional barricade structure.

As can be appreciated, if it is necessary to reverse the traffic flow around the construction site, the contractor need only remove the lens 20 from, for example, the "veer left" instruction of FIG. 5A and flip over and then re-insert or re-couple the lens 20 to the same barricade 26 to form the "veer right" instruction of FIG. 5B.

It should be understood that because of the transparent and translucent nature of the lens 20, there is no need to apply the translucent ink (which form the orange slanted bars) to both opposing faces 27 and 29 (FIG. 4A) of the lens 20; instead, the translucent ink need only be applied on one of the two opposing faces 27 or 29. This feature of not having to apply the translucent ink to both opposing faces carries over into the following embodiments also.

Figure 6A:
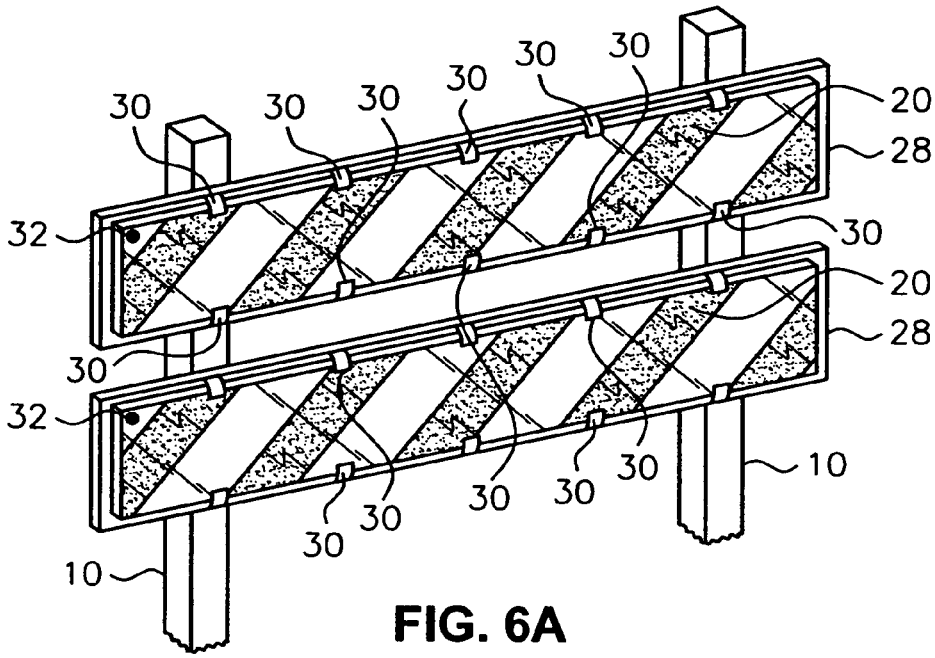
FIG. 6A shows the present invention inserted into a barricade to form a Type II "veer left" slanted bar traffic flow barricade shown partially.

The use of the lens 20 in such Type I barricades can be easily configured for use in Type II barricades. For example, as shown in FIG. 6A, there is a pair of lens 20 vertically-aligned in a respective cutout, relief, cavity or sleeve 28 that are mounted to posts 10 of a Type II barricade; clamps, stops, etc. 30 are provided with each cutout, relief or cavity as discussed previously. It should be further noted that orientation indicia 32 are provided (e.g., a dot) that alerts the contractor to verifying that the lenses 20 are placed in the same orientation in their respective cutouts, reliefs, cavities or sleeves 28. Furthermore, as with the Type I barricade, the background (not shown) of each cutout, relief, cavity or sleeve 28 is covered or coated with a reflective material.

Figure 6B:
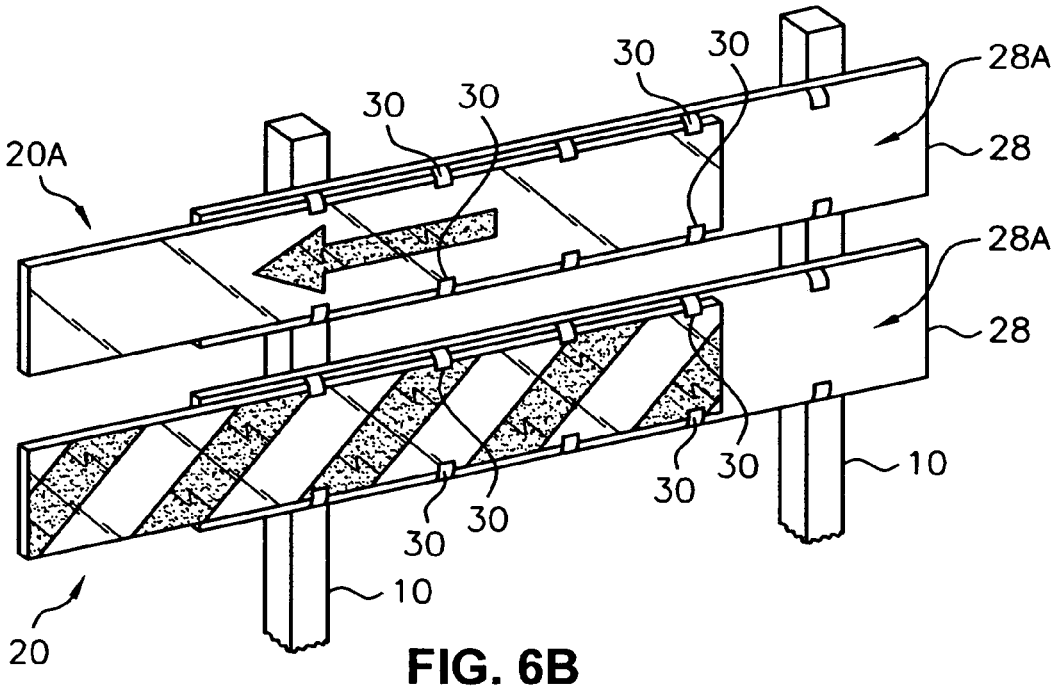
FIG. 6B shows the present invention inserted into a barricade to form a directional Type II "veer left" slanted bar traffic flow barricade shown partially.

FIG. 6B provides an example of a directional Type II barricade using the lens 20 (as described earlier using a transparent material 22 (e.g., clear polycarbonate, such as GE Lexan®, or acrylic or glass)) in the lower cutout, relief, cavity or sleeve (by way of example only). The lens used in the upper cutout, relief, cavity or sleeve 28, namely, 20A, may comprise an orange translucent substrate, or an orange translucent ink applied to a clear material or substrate upon which an opaque arrow is formed (e.g., using an opaque ink or opaque material applied to the substrate). With particular regard to the lens 20A, it should be noted that to "reverse" direction of the arrow, the lens 20A is not flipped over, but rather rotated about a vertical axis and then re-inserted or re-coupled to the same barricade 26. Thus, to "reverse" the veer instruction of the lens 20, the lens 20 can be either be flipped over, or rotated about a vertical axis, whereas to "reverse" the veer instruction of the lens 20A, the lens 20A can only be rotated about a vertical axis. It should further be noted the because of the translucent nature of the lens 20A, there is no need to apply the opaque arrow to both opposing faces of the lens 20A, as described earlier with respect to the orange slanted bars and the opposing faces 27/29 of the lens 20.

Figure 2A:
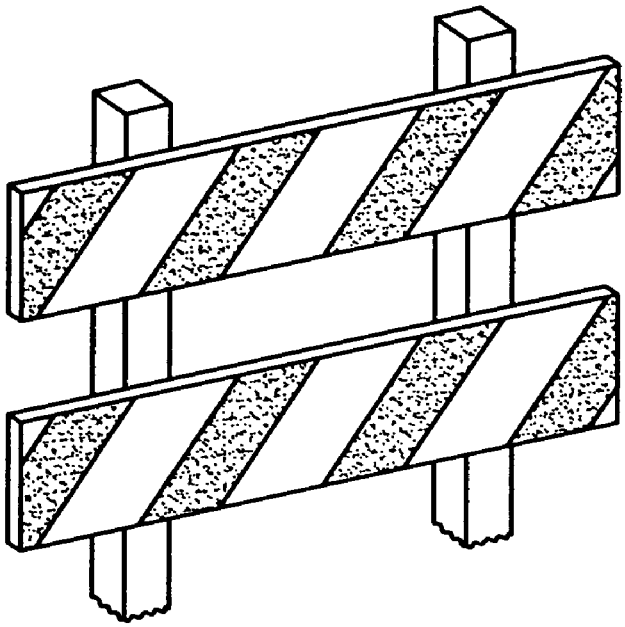
FIG. 2A (Prior Art)
FIG. 2A depicts a Type II barricade including dualized "veer right" slanted bar traffic flow instruction indicia.
Figure 2B:
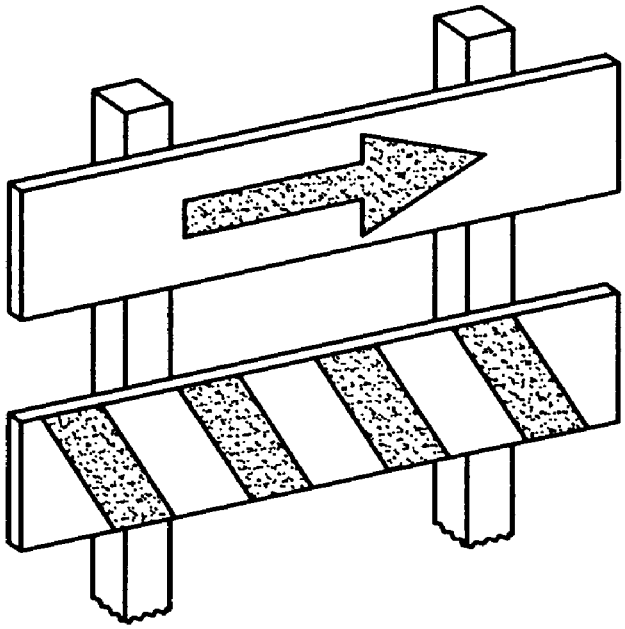
FIG. 2B (Prior Art)
FIG. 2B depicts a Directional Type II barricade including an arrow and a single "veer to the right" slanted bar traffic flow instruction indicia.
Figure 2C:
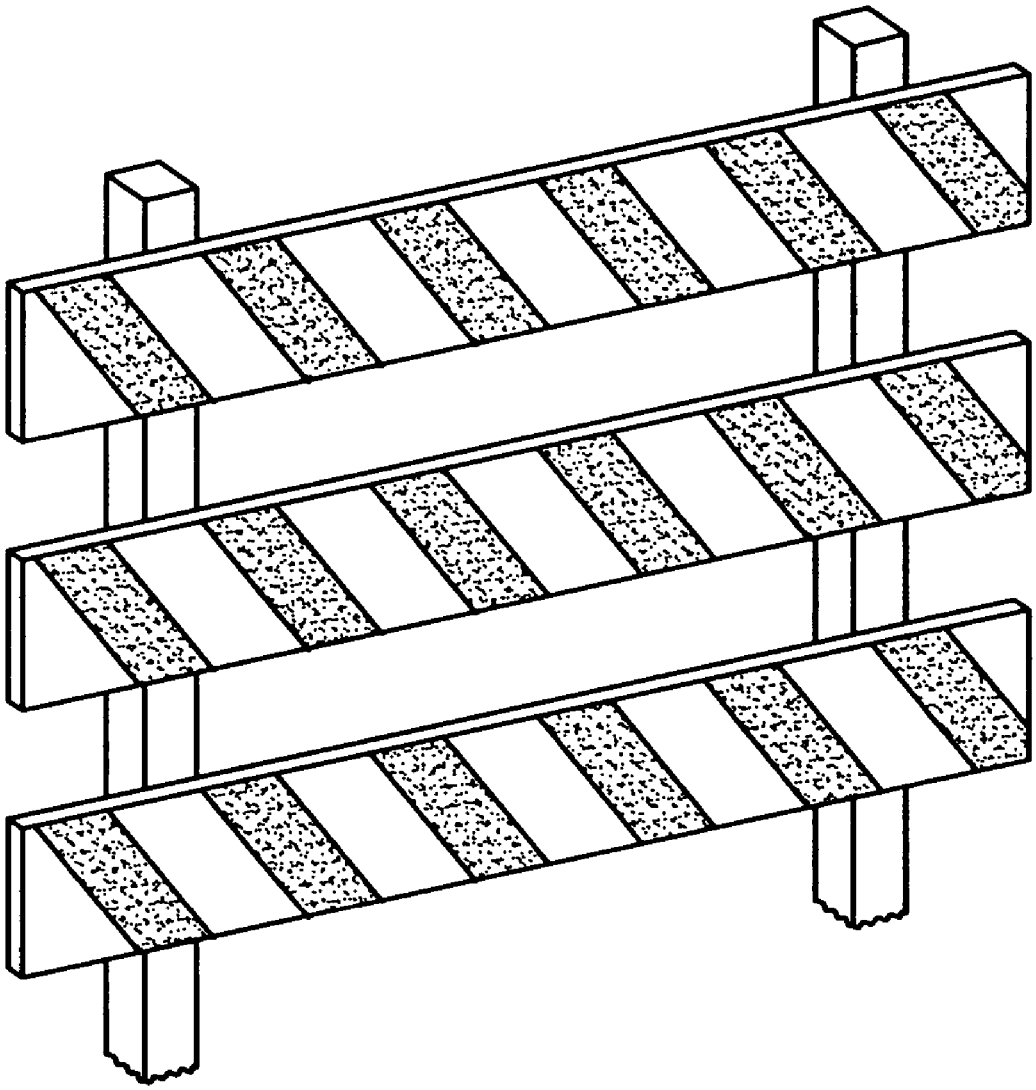
FIG. 2C (Prior Art)
FIG. 2C depicts a Type III barricade including triplicate "veer right" slanted bar traffic flow instruction indicia.

A Type III barricade (see FIG. 2C) can use the lens 20 (as described earlier using a transparent material 22 (e.g., clear polycarbonate, such as GE Lexan®, or acrylic or glass)) in all three of the cutouts, reliefs, cavities or sleeves (by way of example only). Except for the dimension requirements of Type III barricades according to the MUTCD and the Millenium Standard, the operation of the present invention 20 when used in a Type III barricade is similar to the previous discussion with regard to the use of the present invention 20 in the Type II barricade and therefore no further discussion is required.

Figure 7:
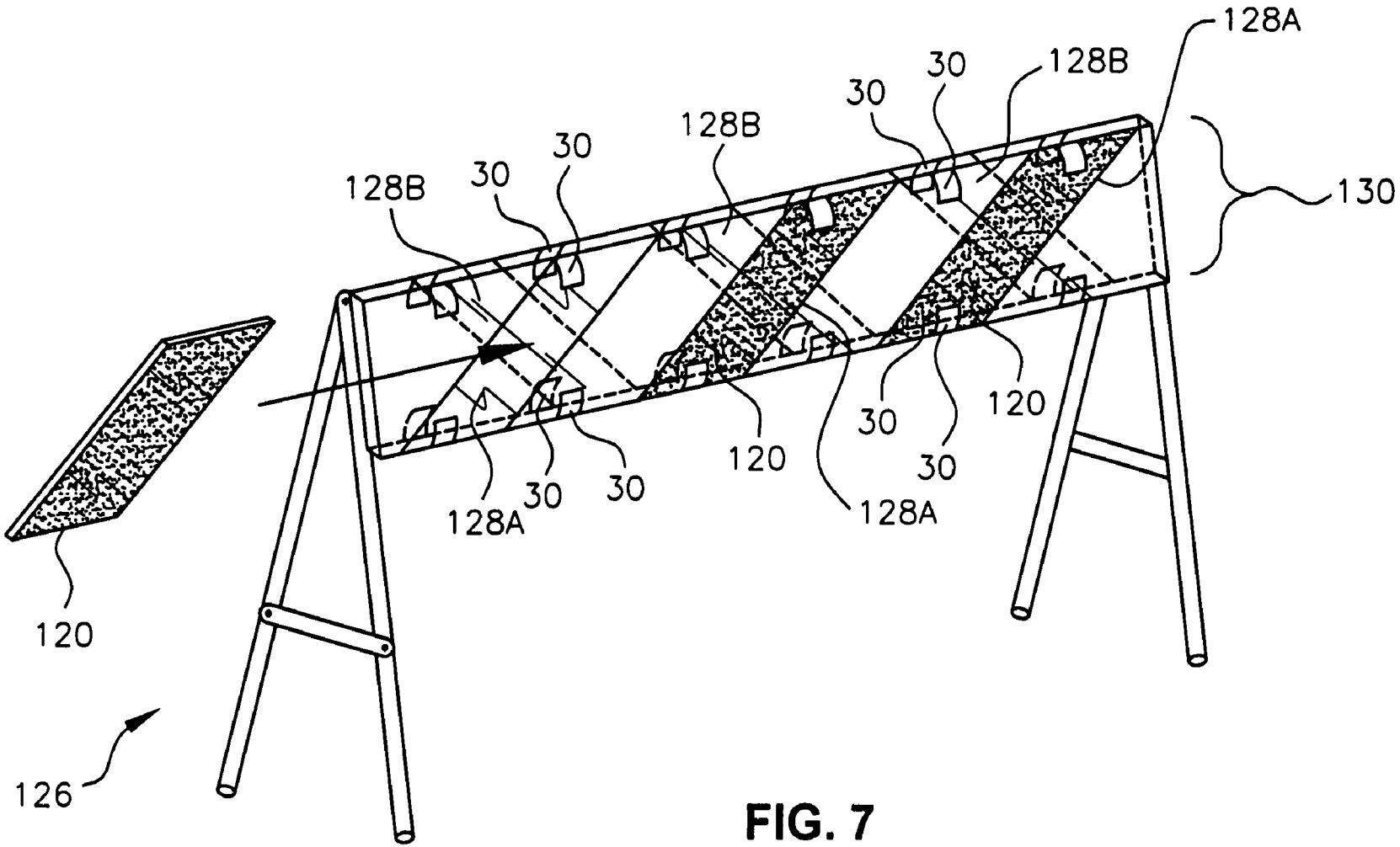
FIG. 7 shows another embodiment of the present invention wherein a lens is formed for each slanted bar in a barricade to form a first veer instruction and wherein each lens is reversible to form the opposite veer instruction.

A further modification of the present invention 20, comprises the use of a series of lenses 120 for each part of the slanted bar veer instruction. By way of example only (since this modification can apply to Type II, including directional Type II, barricades and Type III barricades), there is shown in FIG. 7 a Type I barricade using a plurality of small lenses 120 that are inserted into, or otherwise releasably coupled to, a specially-molded barricade head 130 of barricade 126. In particular, the barricade head 130 comprises a plurality of slanted bar receptacles 128A and 128B (e.g., cutout, relief, cavity or sleeve) which are spaced in the barricade head 130 according to regulation standards. To form a "veer left" instruction, as shown in FIG. 7, each of the lenses 120 are inserted into, or otherwise releasably coupled to, a corresponding slanted bar receptacle 128A; alternatively, to form a "veer right" instruction, all of the lenses 120 are removed, flipped over and then inserted into, or coupled to, a corresponding slanted bar receptacle 128B. Each of the lenses 120 comprises an orange translucent substrate, or an orange translucent ink applied to a clear material or substrate that can be fitted into the slanted bar receptacles 128A or 128B. Clamps, stops, etc. 30 can be provided to releasably secure the individual lenses 120 to their respective slanted bar receptacles 128A/128B. It should be understood that the slanted bar receptacles 128A and 128B, as well as the portions of the barricade head 130 that are located between the bar receptacles 128A/128B are reflective (e.g., covered with reflective tape or a reflective coating). Thus, the barricade contractor can be provided with a plurality of these barricades 126 along with packets of slanted bar lenses 120 (for Type I, Type II and Type III barricades) that can be coupled to the barricade head 130 to form the appropriate veer instruction.

Thus, as can be appreciated, the reversible lenses 20, 20A and 120 of the present invention provide an efficient and less costly solution to contractors for deploying proper traffic flow barricades.

It should be understood that the scope of the invention is not limited to Type I and Type II barricades. The invention has many other applications such as pedestrian signs for use on sidewalks, in front of restaurants, etc. In those scenarios, the need for a reflective background in the cutout, relief, cavity or sleeve is optional. Also, the orientation of the signs in those scenarios may be along a vertical axis rather than a horizontal axis. In any case, the present invention has a wide variety applications.

While the invention has been described in detail and with reference to specific examples thereof, it will be apparent to one skilled in the art that various changes and modifications can be made therein without departing from the spirit and scope thereof.

What is claimed is:

1. A traffic barricade comprising:

a portion for providing alternating slanted bar traffic flow indicia;

a stand for supporting said portion; and wherein said alternating slanted bar traffic flow indicia comprise a plurality of slanted bar lenses, each one of said slanted bar lenses comprising a translucent material that can be positioned in a first veer direction or in a second veer direction, opposite to said first veer direction.

2. The traffic barricade of claim 1 wherein said portion forms a reflective background for said alternating slanted bar traffic flow indicia.

3. The traffic barricade of claim 2 wherein each slanted bar lens comprises a translucent orange material.

4. The traffic barricade of claim 2 wherein each slanted bar lens comprises an orange translucent ink applied to a clear material or substrate.

5. The traffic barricade of claim 1 wherein said portion comprises means for positioning each of said slanted bar lenses in a first veer direction or in a second veer direction.

6. A method for providing a reversible traffic barricade, said method comprises the steps of:

preparing a plurality of translucent slanted bar lenses;

configuring a barricade stand to receive said plurality of translucent slanted bar lenses;

applying a reflective coating to that portion of said barricade that receives said plurality of slanted bar lenses; and releasably coupling said plurality of slanted bar lenses to said barricade to form a barricade that provides traffic flow instruction in a first direction.

7. The method of claim 6 further comprising the steps of:

removing said plurality of slanted bar lenses from said barricade;

reversing said plurality of slanted bar lenses; and releasably coupling said plurality of slanted bar lenses to said barricade to form a barricade that provides traffic flow in a second direction, opposite to said first direction.

* * * * *